US008939666B2

(12) United States Patent
Tamai et al.

(10) Patent No.: US 8,939,666 B2
(45) Date of Patent: Jan. 27, 2015

(54) RECORDING APPARATUS FOR DETECTING MARKS ON TARGETS

(75) Inventors: Masayuki Tamai, Wakayama (JP); Satoshi Morikawa, Wakayama (JP)

(73) Assignee: Seiko Epson Corporation, Tokyo (JP)

( * ) Notice: Subject to any disclaimer, the term of this patent is extended or adjusted under 35 U.S.C. 154(b) by 454 days.

(21) Appl. No.: 12/623,600

(22) Filed: Nov. 23, 2009

(65) Prior Publication Data

US 2010/0135710 A1 Jun. 3, 2010

(30) Foreign Application Priority Data

Dec. 1, 2008 (JP) ..... 2008-306184

(51) Int. Cl.

| | |
|---|---|
| ***B41J 11/46*** | (2006.01) |
| ***B41J 15/00*** | (2006.01) |
| ***B41J 15/16*** | (2006.01) |
| ***B65H 23/188*** | (2006.01) |
| *B41J 11/00* | (2006.01) |

(52) U.S. Cl.

CPC ..... *B65H 23/1882* (2013.01); *B41J 11/0095* (2013.01); *B41J 15/165* (2013.01); *B65H 2511/512* (2013.01); *B65H 2553/414* (2013.01); *B65H 2801/12* (2013.01)

USPC ..... 400/618; 400/611; 400/583; 400/691; 400/693; 347/104

(58) Field of Classification Search

USPC ..... 400/618; 101/181; 399/384

See application file for complete search history.

(56) References Cited

U.S. PATENT DOCUMENTS

| | | | | |
|---|---|---|---|---|
| 3,919,561 | A | 11/1975 | Coberley | |
| 5,208,612 | A * | 5/1993 | Obu et al. | 347/152 |
| 5,761,570 | A * | 6/1998 | Sawayama et al. | 399/49 |
| 6,566,670 | B1 | 5/2003 | Buisker et al. | |
| 6,717,168 | B2 * | 4/2004 | Eisen et al. | 250/559.36 |
| 6,988,797 | B2 * | 1/2006 | Samii et al. | 347/106 |
| 7,167,673 | B2 * | 1/2007 | Cahill et al. | 399/384 |
| 7,384,110 | B2 | 6/2008 | Hoshiyama et al. | |
| 7,917,047 | B2 * | 3/2011 | Takishita | 399/49 |
| 2001/0042847 | A1 | 11/2001 | Eisen et al. | |
| 2002/0102114 | A1 * | 8/2002 | Kawanishi | 399/301 |
| 2005/0169528 | A1 | 8/2005 | Lampersberger | |
| 2006/0164506 | A1 * | 7/2006 | Kitao | 347/236 |

(Continued)

FOREIGN PATENT DOCUMENTS

| | | |
|---|---|---|
| JP | 04-241970 | 8/1992 |
| JP | 08-174948 | 7/1996 |
| JP | 2003-040487 | 2/2003 |
| JP | 2003-246551 | 9/2003 |

(Continued)

*Primary Examiner* — Daniel J Colilla
*Assistant Examiner* — Justin Olamit
(74) *Attorney, Agent, or Firm* — Workman Nydegger

(57) ABSTRACT

A recording apparatus includes: a first support unit which is disposed at an intermediate location of a transport path of the target and supports the target; a second support unit which is disposed at a location of a downstream side of the transport path of the target further than the first support unit and supports the target; a tension applying member which is disposed at a location of the target transport path between the first support unit and the second support unit and pressures the target from one side thereof to apply a tension to the target; and an optical detection unit which is disposed at a location corresponding to the tension applying member to face the other side of the target and irradiates detection light to a surface of the other side of the target to which the tension is applied by the tension applying member.

8 Claims, 3 Drawing Sheets

(56) References Cited

U.S. PATENT DOCUMENTS

| | | | | |
|---|---|---|---|---|
| 2006/0219109 | A1 | 10/2006 | Cadillach | |
| 2008/0069607 | A1* | 3/2008 | Otani | 399/308 |
| 2008/0187351 | A1* | 8/2008 | Takishita | 399/101 |

FOREIGN PATENT DOCUMENTS

| | | |
|---|---|---|
| JP | 2005-196646 | 7/2005 |
| JP | 2005-206307 | 8/2005 |
| WO | 87-06190 | 10/1987 |

* cited by examiner

RECORDING APPARATUS FOR DETECTING MARKS ON TARGETS

BACKGROUND

1. Technical Field

The present invention relates to a recording apparatus such as an ink jet type printer.

2. Related Art

Generally, a recording apparatus which performs recording processing on a long-sized target, which is transported from an upstream side to a downstream side, through a recording unit is well known. In the recording apparatus, in order to intermittently transport the target from an upstream side of a transport direction to a downstream side and stop transporting at an appropriate location for the recording unit to perform recording processing, detection light may be irradiated from an optical sensor to the target to detect a mark formed on the target.

A conventional technique for detecting a mark formed on a target through an optical sensor is disclosed in JP-A-2003-246551. That is, in JP-A-2003-246551, a mark on a mark type ballot paper (a target) transported by various rollers is read by an image sensor (an optical detection unit) between predetermined rollers.

However, in JP-A-2003-246551, since the mark on the mark type ballot paper is read by the image sensor between predetermined rollers, when the mark type ballot paper vibrates during transporting, there is a problem in that the mark type ballot paper becomes unstable, and the accuracy for detecting the mark on the mark type ballot paper through the image sensor deteriorates.

SUMMARY

An advantage of some aspects of the invention is that it provides a recording apparatus in which the accuracy for detecting the target through an optical detection unit is improved.

According to an aspect of the invention, there is provided a recording apparatus which performs recording processing on a target which is transported from an upstream side to a downstream side, including: a first support unit which is disposed at an intermediate location of a transport path of the target and supports the target; a second support unit which is disposed at a location of a downstream side of the transport path of the target further than the first support unit and supports the target; a tension applying member which is disposed at a location of the target transport path between the first support unit and the second support unit and pressures the target from one side thereof to apply a tension on the target; and an optical detection unit which is disposed at a location corresponding to the tension applying member to face the other side of the target and irradiates detection light to a surface of the other side of the target to which the tension is applied by the tension applying member.

According to the invention, since the optical detection unit irradiates detection light to a surface of the other side of the target to which the tension is applied by the tension applying member, an area of the target to which detection light is irradiated is prevented from rippling or vibrating, and detection is performed by the optical detection unit in a stabilized state. Therefore, the accuracy for detecting the target through the optical detection unit can be improved.

In the recording apparatus of the invention, the tension applying member may be a rolling roller which is disposed to come into contact with the one side of the target in a pressured state, and the optical detection unit may irradiate the detection light towards a surface of the other side of a portion which supports the one side of the target at an outer peripheral surface of the rolling roller.

According to the invention, tension can be applied to the target while suppressing resistance at the time of transporting the target.

In the recording apparatus of the invention, the optical detection unit may irradiate the detection light towards a central location of a transport direction of a portion of the target supported arcuately along an outer peripheral surface of the rolling roller.

According to the invention, even if an irradiation direction of detection light deviates due to installation errors of the optical detection unit, detection light can be prevented from deviating from the surface of the other side of the target corresponding to a contact area of the rolling roller.

In the recording apparatus of the invention, the optical detection unit may irradiate the detection light to a surface of the other side of the target from an oblique direction.

According to the invention, even when the surface of the other side of the target is lustrous, the accuracy for detecting the target through the optical detection unit can be maintained.

In the recording apparatus of the invention, the optical detection unit may irradiate the detection light along a width direction of the target when irradiating the detection light to the surface of the other side of the target from the oblique direction.

According to the invention, the target can be detected by the optical detection unit with high accuracy.

BRIEF DESCRIPTION OF THE DRAWINGS

The invention will be described with reference to the accompanying drawings, wherein like reference numbers represent like elements.

DESCRIPTION OF EXEMPLARY EMBODIMENTS

Hereinafter, an embodiment in which a recording apparatus of the invention is embodied as an ink jet type printer will be described with reference to the accompanying drawings. In the below description, a "front-rear direction", a "left-right direction", and an "up-down direction" are indicated based on a direction indicated by a solid line of FIG. 1.

Figure 1:
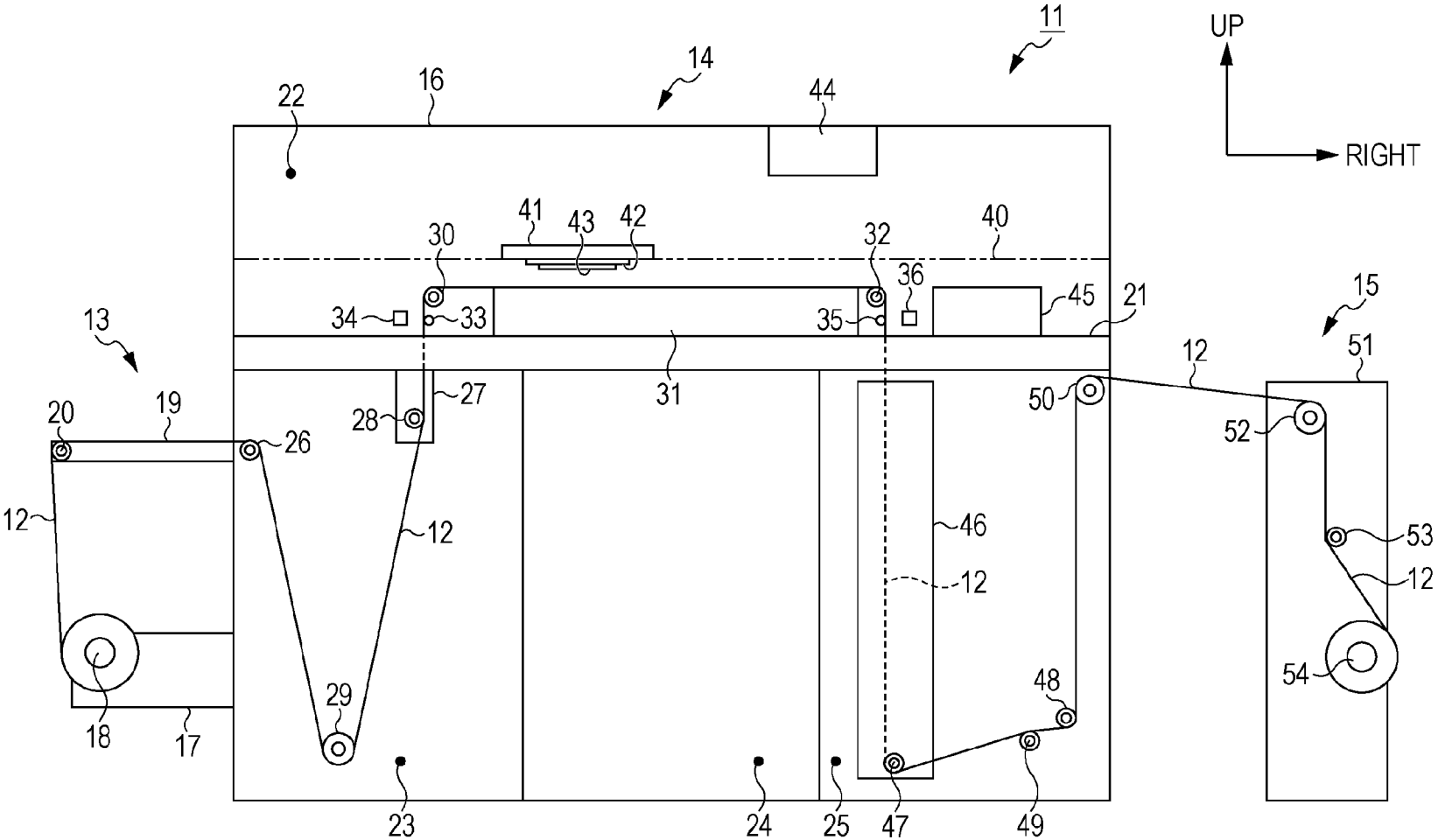
FIG. 1 is a schematic front view of an ink jet type printer according to an exemplary embodiment.

As illustrated in FIG. 1, an ink jet type printer 11 as a recording apparatus includes a feed unit 13 which feeds a continuous paper 12 as a long-sized target, a body 14 which performs sequential printing on the continuous paper 12 fed from the feed unit 13 and dries the continuous paper 12, and a winding unit 15 which winds the continuous paper 12 in which printing has been performed and dried. That is, the body 14 includes a body case 16 of a rectangular parallelepiped shape, the feed unit 13 is disposed at a left side of the body case 16 which is an upstream side of a transport direction of the continuous paper 12, and the winding unit 15 is disposed at a right side of the body case 16 which is a downstream side.

The feed unit 13 includes a pair of front and rear support plates 17 which extend in a leftwardly direction along a vertical surface from a left surface lower end of the body case 16. Support concave portion (not shown) are formed on upper surface right ends of the both support plates 17, respectively, and both ends of a winding shaft 18 by which the rolled continuous paper 12 is supported by a central portion thereof are rotatably supported by the both support concave portions. Therefore, the rolled continuous paper 12 is disposed between the both support plates 17. As the continuous paper 12 of the present embodiment, an adhesive label sheet is used in which a surface which is a printing target surface is lustrous, and an opposite surface on which adhesive paste is coated is protected by a release paper.

The feed unit 13 includes a feed stand 19 of a flat panel shape which horizontally extends in a leftwardly direction from a left surface central portion of the body case 16. A relay roller 20 which winds the continuous paper 12 fed from the winding shaft 18 and guides the continuous paper 12 onto a top surface of the feed stand 19 is rotatably disposed on a front end of the feed stand 19.

In the inside of the body case 16 of the body 14, a frame 21 of a rectangular shape which partitions the inside of the body case 16 into up and down is disposed on at a location which is slightly higher than a central portion of an up-down direction. An area which is higher than the frame 21 in the inside of the body case 16 is used as a printing chamber 22 for performing printing on the continuous paper 12. An area which is lower than the frame 21 in the inside of the body case 16 is partitioned into three compartments 23, 24, and 25 which are disposed in parallel in a left-right direction. The three compartments are referred to as a first compartment 23, a second compartment 24, and a third compartment 25, respectively, in order from the left.

A carrying-in opening (not shown) through which the continuous paper 12 is carried into the first compartment 23 from a top surface of the feed stand 19 is formed in a left wall of the body case 16. A pull-in driving roller 26 which faces the carrying-in opening at an adjacent location is disposed in the first compartment 23 to be rotatably driven. Therefore, when the pull-in driving roller 26 is driven, the continuous paper 12 is pulled into the first compartment 23 through the carrying-in opening.

A pair of front and rear support plates 27 is vertically disposed at a predetermined interval on a bottom surface of the frame 21 in the inside of the first compartment 23. The both support plates 27 are located at a right side further than the pull-in driving roller 26. A relay roller 28 as a first support unit is rotatably supported between lower ends of the both support plates 27.

An elevating roller 29 which moves up and down based on driving of an elevating mechanism (not shown) is disposed between the pull-in driving roller 26 and the relay roller 28 in the inside of the first compartment 23. The continuous paper 12 transported from the pull-in driving roller 26 side is wound around the elevating roller 29 from the downside.

The length of the continuous paper 12 located between the pull-in driving roller 26 and the relay roller 28 increases as the elevating roller 29 moves down and decreases as the elevating roller 29 moves up. That is, as the elevating roller 29 is located at the downside, a transport distance the continuous paper 12 located between the pull-in driving roller 26 and the relay roller 28 increases, while as the elevating roller 29 is located at the upside, a transport distance the continuous paper 12 located between the pull-in driving roller 26 and the relay roller 28 decreases. The continuous paper 12 transported from the elevating roller 29 side is wound around the relay roller 28 to be directed to a position close to a left end of the printing chamber 22.

As illustrated in FIG. 1, a relay roller 30 as a second support unit is disposed at a location, inside the printing chamber 22, facing the relay roller 28 across the frame 21. The continuous paper 12 which is transported from the relay roller 28 side through the inside of the frame 21 is wound around the relay roller 30 from a lower left direction and then horizontally transported in a right direction.

A rolling roller 33 as a tension applying member is rotatably disposed, at a location adjacent to the relay roller 30, between the relay roller 28 and the relay roller 30 in the transport path of the continuous paper 12 to come into contact with an opposite surface which is a non-printing surface of the continuous paper 12 in a pressed state. A reflective photo sensor 34 as an optical detection unit which irradiates detection light to a surface which is a printing target surface of the continuous paper 12 is disposed at a location facing the rolling roller 33 across the continuous paper 12.

In the inside of the printing chamber 22, a platen unit 31 of a rectangular parallelepiped shape is disposed on an area of the frame 21 at a right side of the relay roller 30. In the inside of the printing chamber 22, a change-over roller 32 as a first support unit is disposed at a right side of the platen unit 31 to face the relay roller 30 across the platen unit 31. In this case, a top surface of the relay roller 30, a top surface of the platen unit 31, and a top surface of the change-over roller 32 are flush with each other.

The continuous paper 12 transported from the relay roller 30 in a horizontally rightwardly direction along a top surface of the plate unit 31 is wound around the change-over roller 32 from an upper left direction, so that its transport direction changes from a horizontal right direction to a vertically downwardly direction. The continuous paper 12 whose transport direction has changed to the vertically downwardly direction through the change-over roller 32 is transported into the third compartment 25 through the inside of the frame 21.

In the inside of the printing chamber 22, a pair of guide rails 40 (which are indicated by a dashed two-dotted line in FIG. 1) which extends in a left-right direction is disposed at both front and rear sides of the platen unit 31. Top surfaces of the guide rail 40 are higher than the top surface of the platen unit 31. A carriage 41 of a rectangular plate shape is supported on the top surfaces of the both guide rails 40 to be able reciprocally to move in a left-right direction along the both guide rails 40. The carriage 41 reciprocally moves on the both guide rails 40 based on driving of a driving mechanism (not shown).

A slide plate 42 of a rectangular plate shape is disposed on a bottom surface of the carriage 41 to be able slidably to move the carriage 41 in a front-rear direction. A recording head 43 is supported on a bottom surface of the slide plate 42. A plurality of valve units 44 for temporarily retaining ink is disposed in an upper end of the inside of the printing chamber 22. The respective valve units 44 retain inks of different colors.

The respective valve units 44 are connected to the recording head 43 through ink supply tubes (not shown), respectively. Each ink is supplied to the recording head 43 through each ink supply tube. A plurality of nozzle openings (not shown) is disposed on a bottom surface of the recording head 43. Ink supplied from each valve unit 44 is ejected towards a surface of the continuous paper 12 which is transported and stopped on the platen unit 31 from each nozzle opening, whereby printing as recording processing is performed.

Further, in the inside of the body case 16, a plurality of ink cartridges (not shown) which retains inks of different colors is detachably mounted. The ink cartridges are connected to the valve units 44 through the ink supplying tubes (not shown) in a state which can supply ink, respectively.

In the inside of the body case 16, a pressure pump (not shown) which pressures inks in the respective ink cartridges (not shown) is disposed. When the pressure pump is driven, inks in the respective cartridges are pressured and supplied to the respective valve units 44 through the ink supply tube (not shown), respectively. A maintenance unit 45 which performs the maintenance such as cleaning of the recording head 43 is disposed at a right side of the change-over roller 32 on the frame 21 inside the printing chamber 22.

As illustrated in FIG. 1, a forced drying apparatus 46 of a rectangular parallelepiped shape which forcibly dries the continuous paper 12 on which printing has been performed is disposed at a location closer to the left in the inside of the third compartment 25. The continuous paper 12 which is wound around the change-over roller 32 and transported in a vertically downward direction passes through the forced drying apparatus 46, is wound around an inversion roller 47 as a second support unit, which is rotatably disposed at a lower side of the forced drying apparatus 46, from an upper left direction, and is transported in a slightly oblique right upward direction.

A rolling roller 35 as a tension applying member is rotatably disposed, at a location adjacent to the change-over roller 32, between the change-over roller 32 and the inversion roller 47 in the transport path of the continuous paper 12 to come in contact with an opposite surface which is a non-printing surface of the continuous paper 12 in a pressed state. A reflective photo sensor 36 as an optical detection unit which irradiates detection light to a surface which is a printing target surface of the continuous paper 12 is disposed at a location facing the rolling roller 35 across the continuous paper 12.

The continuous paper 12 which is transported in an oblique right upward direction from the inversion roller 47 is wound around a relay roller 48, which is rotatably disposed to a lower right portion of the inside of the third compartment 25, from a lower left direction and transported in an upward direction along a right wall of the body case 16 in the inside of the third compartment 25. In the inside of the third compartment 25, a dancer roller 49 which pressures the continuous paper 12 from a lower side thereof to apply tensional force to the continuous paper 12 which has been dried by the forced drying apparatus 46 is disposed at a location between the inversion roller 47 and the relay roller 48.

In the right wall of the body case 16, a discharge opening (not shown) through which the continuous paper 12 is discharged to the winding unit 15 is disposed at a location corresponding to an upper end of the third compartment 25. A delivery driving roller 50 is disposed to rotatably be driven to face the discharge opening at an adjacent location in the third compartment 25. When the delivery driving roller 50 is driven, the continuous paper 12 is delivered to the winding unit 15 side through the discharge opening.

The winding unit 15 includes a winding frame 51 of a rectangular parallelepiped shape, and the height of the winding frame 51 is almost equal to the height of the delivery driving roller 50. A relay roller 52 is rotatably disposed on an upper end of a front surface of the winding frame 51. The continuous paper 12 which has been delivered from the discharge opening (not shown) is wound around the relay roller 52 from an upper leftwardly direction and transported in a downwardly direction.

A relay roller 53 is rotatably disposed at a location of the front surface of the winding frame 51 below the relay roller 52. The continuous paper 12 which has been transported from the relay roller 52 is wound around the relay roller 53 from a left side and transported in an oblique right downward direction.

On the front surface of the winding frame 51, a winding driving shaft 54 which extends in a front direction is rotatably supported to the winding frame 51 at an oblique right downward side of the relay roller 53. The continuous paper 12 which has been transported from the relay roller 53 is wound around the winding driving shaft 54, and when the winding driving shaft 54 is rotatably driven, the continuous paper 12 sequentially is wound.

The pull-in driving roller 26 and the delivery driving roller 50 are electrically connected to a controller 37 which controls an operation state of the ink jet type printer 11 and are driven and controlled by the controller 37. The controller 37 repetitively drives and stops the pull-in driving roller 26 and the delivery driving roller 50 to thereby intermittently transport the continuous paper 12 along the transport path.

Next, a detection mechanism which detects the continuous paper 12 using the photo sensor 34 will be described.

Figure 2:
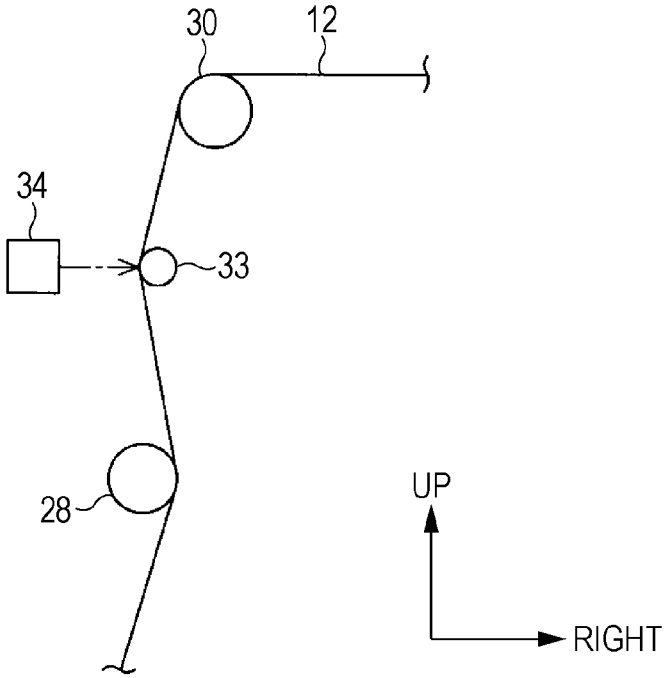
FIG. 2 is a main part enlarged view of FIG. 1.
Figure 3:
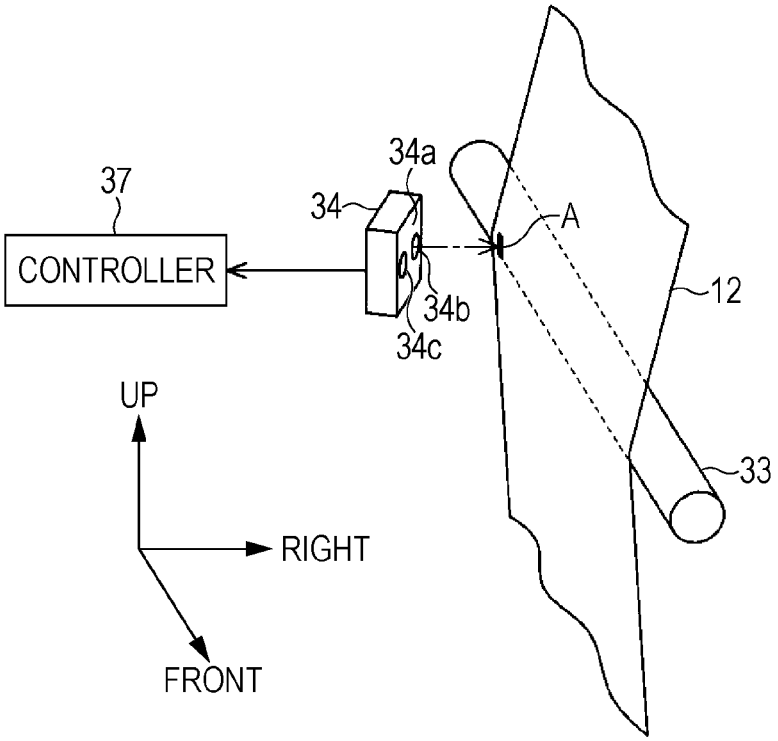
FIG. 3 is an enlarged perspective view of FIG. 2.

As illustrated in FIGS. 2 and 3, the photo sensor 34 is disposed to face a rear end edge of a surface of the continuous paper 12, and a facing surface 34*a* which faces the continuous paper 12 face an oblique right front direction. That is, the photo sensor 34 is disposed so that the facing surface 34*a* is slightly inclined to face the front side with respect to the surface of the continuous paper 12.

A light emitting unit 34*b* which irradiates detection light to the continuous paper 12 and a light receiving unit 34*c* which receives reflection light of detection light irradiated to the continuous paper 12 from the light emitting unit 34*b* are disposed on the facing surface 34*a* of the photo sensor 34. The photo sensor 34 is electrically connected to the controller 37. The light emitting unit 34*b* of the photo sensor 34 irradiates detection light to a surface of the continuous paper 12, which corresponds to a central position of a transport direction among portions by which an opposite surface is arcuately supported at an outer peripheral surface of the rolling roller 33 when seen in a front-rear direction, along a front-rear direction which is a width direction of the continuous paper 12 from an oblique direction.

In the case of using the continuous paper 12 in which a double printing mark A is formed at a rear end edge of the surface thereof, the double printing mark A is detected by the photo sensor 34. The double printing mark A is formed at a downstream side of an already printed area which is an area in which base printing has already been performed on the surface of the continuous paper 12. The already printed area of the continuous paper 12 is formed over the whole continuous paper 12 at the same interval along a longitudinal direction of the continuous paper 12. Therefore, the double printing mark A is also formed over the whole continuous paper 12 at the same interval in a longitudinal direction of the continuous paper 12.

Next, a detection mechanism which detects the continuous paper 12 using a photo sensor 36 will be described.

Figure 4:
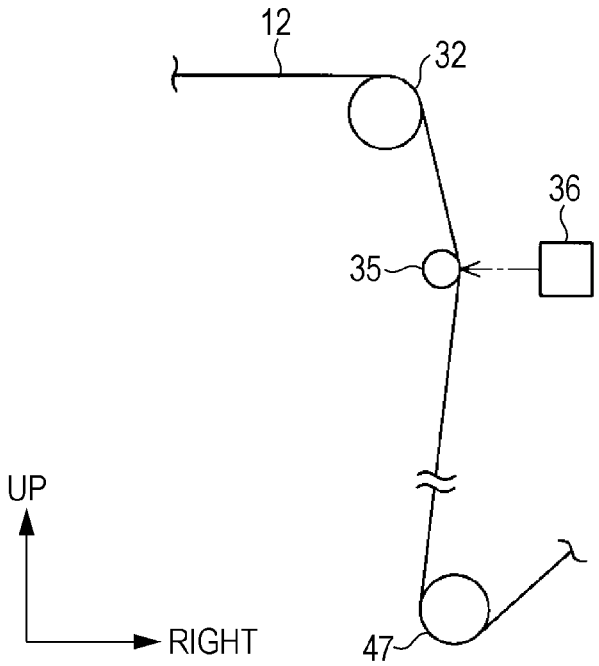
FIG. 4 is a main part enlarged view of FIG. 1.
Figure 5:
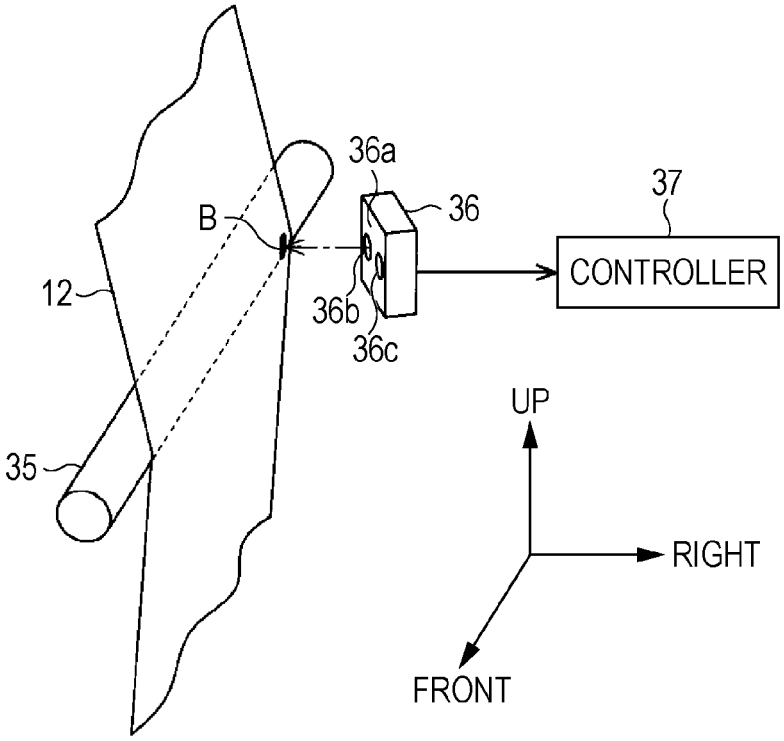
FIG. 5 is an enlarged perspective view of FIG. 4.

As illustrated in FIGS. 4 and 5, the photo sensor 36 is disposed to face a rear end edge of the surface of the continuous paper 12, and a facing surface 36*a* which faces the continuous paper 12 faces an oblique left front direction. That is, the photo sensor 36 is disposed so that the facing surface 36*a* is slightly inclined to face the front side with respect to the surface of the continuous paper 12.

A light emitting unit 36*b* which irradiates detection light to the continuous paper 12 and a light receiving unit 36*c* which receives reflection light of detection light irradiated to the continuous paper 12 from the light emitting unit 36*b* are disposed on the facing surface 36*a* of the photo sensor 36. The photo sensor 36 is electrically connected to the controller 37. The light emitting unit 36*b* of the photo sensor 36 irradiates detection light to a surface of the continuous paper 12, which corresponds to a central position of a transport direction among portions by which an opposite surface is arcuately supported at an outer peripheral surface of the rolling roller 35 when seen in a front-rear direction, along a front-rear direction which is a width direction of the continuous paper 12 from an oblique direction.

In the case of using the unprinted continuous paper 12 in which a page break mark B is formed at a rear end edge of a surface, the page break mark B is detected by the photo sensor 36. The page break mark B is formed over the whole continuous paper 12 at the same interval in a longitudinal direction of the continuous paper 12.

Next, an operation of the ink jet type printer 11 will be described.

A Case of Using the Continuous Paper 12 in which the Double Printing Mark A is Formed First, an operation of the ink jet type printer 11 in the case of using the continuous paper 12 in which the double printing mark A is formed will be described.

When the pull-in driving roller 26 and the delivery driving roller 50 are driven by the controller 37, the continuous paper 12 is transported from an upstream side to a downstream side. When detection light emitted from the light emitting unit 34*b* of the photo sensor 34 is irradiated onto the double printing mark A and then diffusion reflection light of detection light is received by the light receiving unit 34*c*, a detection signal of the double printing mark A is transmitted from the photo sensor 34 to the controller 37.

At this time, since an opposite side of the double printing mark A formed on the surface of the continuous paper 12 is pressured by the rolling roller 33, tension is applied to an area of the continuous paper 12 in which the double printing mark A is formed by the rolling roller 33. Accordingly, a phenomenon that the area of the continuous paper 12, in which the double printing mark A is formed, ripples or vibrates is effectively inhibited. The double printing mark A is detected by the photo sensor 34 in a state in which the area of the continuous paper 12 on which the double printing mark A is formed is stabilized. That is, the double printing mark A of the continuous paper 12 is detected by the photo sensor 34 with high accuracy.

Here, since the surface of the continuous paper 12 is lustrous, when the light emitting unit 34*b* irradiates detection light to the double printing mark A of the continuous paper 12 from the front surface, the light receiving unit 34*c* receives regular reflection light of detection light. For this reason, the accuracy for detecting the double printing mark A through the photo sensor 34 significantly deteriorates. In this regard, according to the present invention, since detection light from the light emitting unit 34*b* is irradiated to the double printing mark A from an oblique direction and diffusion reflection light of detection light is received by the light receiving unit 34*c*, even if the surface of the continuous paper 12 is lustrous, the accuracy for detecting the double printing mark A through the photo sensor 34 is maintained.

Subsequently, when the detection signal of the double printing mark A from the photo sensor 34 is received by the controller 37, the controller 37 stops the pull-in driving roller 26 and the delivery driving roller 50 when an already printed area at a direct upstream side of the detected double printing mark A is moved onto the platen unit 31. In this case, a time after the photo sensor 34 detects the double printing mark A until an already printed area at a direct upstream side of the detected double printing mark A is moved onto the platen unit 31 is computed through an experiment in advance and stored in the controller 37, and the controller 37 stops the pull-in driving roller 26 and the delivery driving roller 50 based on this time.

Then, when ink is ejected from the recording head 43 towards an already printed area of the surface of the continuous paper 12 which is transported onto the platen unit 31 and stopped, overlap printing (double printing) is performed on the already printed area. When double printing on the already printed area is completed, the controller 37 drives the pull-in driving roller 26 and the delivery driving roller 50 to transport the continuous paper 12 to a downstream side.

When the detection signal of the double printing mark A from the photo sensor 34 is received again, the controller 37 stops the pull-in driving roller 26 and the delivery driving roller 50 again when an already printed area at a direct upstream side of the detected double printing mark A is moved onto the platen unit 31. Then, ink is ejected from the recording head 43 onto the already printed area of the surface of the continuous paper 12, which is transported onto the platen unit 31 and stopped, to thereby perform double printing.

As described above, ink sequentially is ejected from the recording head 43 to respective already printed areas of the continuous paper 12 on the platen unit 31 while intermittently transporting the continuous paper 12, so that double printing on respective already printed areas is sequentially performed.

A Case of Using the Continuous Paper 12 in which the Page Break Mark B is Formed Next, an operation of the ink jet type printer 11 in the case of using the continuous paper 12 in which the page break mark B is formed will be described.

When the pull-in driving roller 26 and the delivery driving roller 50 are driven by the controller 37, the continuous paper 12 is transported from an upstream side to a downstream side. When detection light emitted from the light emitting unit 36*b* of the photo sensor 36 is irradiated onto the page break mark B and diffusion reflection light of detection light is received by the light receiving unit 36*c*, a detection signal of the page break mark B is transmitted from the photo sensor 36 to the controller 37.

At this time, since an opposite side of the page break mark B formed on the surface of the continuous paper 12 is pressured by the rolling roller 35, tension is applied to an area of the continuous paper 12 in which the page break mark B is formed by the rolling roller 35. Accordingly, a phenomenon that the area of the continuous paper 12, in which the page break mark B is formed, ripples or vibrates is effectively inhibited. The page break mark B is detected by the photo sensor 36 in a state in which the area of the continuous paper 12 on which the page break mark B is formed is stabilized. That is, the page break mark B of the continuous paper 12 is detected by the photo sensor 36 with high accuracy.

Since the surface of the continuous paper 12 is lustrous, when the light emitting unit 36*b* irradiates detection light to the page break mark B of the continuous paper 12 from the front surface, the light receiving unit 36*c* receives regular reflection light of detection light. For this reason, the accuracy for detecting the page break mark B through the photo sensor 36 significantly deteriorates. In this regard, according to the present invention, since detection light from the light emitting unit 36*b* is irradiated to the page break mark B from an oblique direction and diffusion reflection light of detection light is received by the light receiving unit 36*c*, even if the surface of the continuous paper 12 is lustrous, the accuracy for detecting the page break mark B through the photo sensor 36 is maintained.

Subsequently, when the detection signal of the page break mark B from the photo sensor 36 is received by the controller 37, the controller 37 stops the pull-in driving roller 26 and the delivery driving roller 50. When ink is ejected from the recording head 43 towards a non-printed area of the continuous paper 12 positioned on the platen unit 31, printing is performed on the non-printed area. When printing of the non-printed area is completed, the controller 37 drives the pull-in driving roller 26 and the delivery driving roller 50 to transport the continuous paper 12 to a downstream side.

When the detection signal of the page break mark B from the photo sensor 36 is received again, the controller 37 stops the pull-in driving roller 26 and the delivery driving roller 50 again. Then, ink is ejected from the recording head 43 onto the non-printed area of the continuous paper 12 positioned on the platen unit 31 to thereby perform printing.

As described above, ink is ejected from the recording head 43 to the non-printed area of the continuous paper 12 on the platen unit 31 while intermittently transporting the continuous paper 12, so that printing is sequentially performed on the surface of the continuous paper 12 at the same interval. At this time, the page break mark B functions as a mark for intermittently transporting the continuous paper 12 by a predetermined distance (a distance between page break marks B).

According to the embodiment described above, the following effects can be obtained.

(1) The rolling roller 33 and the rolling roller 35 come into contact with the opposite surface of the continuous paper 12 corresponding to the surface on which the photo sensor 34 and the photo sensor 36 are disposed in a pressured state. For this reason, in the case of detecting the double printing mark A and the page break mark B formed on the surface of the continuous paper 12 through the photo sensor 34 and the photo sensor 36, respectively, an area of the continuous paper 12 to which detection light is irradiated from the photo sensor 34 and the photo sensor 36 can effectively be inhibited from rippling or vibrating. Therefore, the double printing mark A and the page break mark B formed on the surface of the continuous paper 12 can be detected by the photo sensor 34 and the photo sensor 36, respectively, in a state in which the continuous paper 12 is stabilized. Therefore, the accuracy for detecting the double printing mark A and the page break mark B formed on the surface of the continuous paper 12 through the photo sensor 34 and the photo sensor 36, respectively, can be improved.

(2) The rolling roller 33 and the rolling roller 35 are configured to rotate while transporting the continuous paper 12. Therefore, in the case of detecting the double printing mark A and the page break mark B through the photo sensor 34 and the photo sensor 36, respectively, when the continuous paper 12 is transported, tension can be applied to an area of the continuous paper 12 in which the double printing mark A and the page beak mark B are formed while suppressing resistance of the rolling roller 33 and the rolling roller 35.

(3) The photo sensor 34 and the photo sensor 36 are disposed to irradiate detection light to a location of the surface side of the continuous paper 12, which corresponds to a central location of the transport direction among portions by which an opposite surface side is arcuately supported at an outer peripheral surface of the rolling roller 33 and the rolling roller 35, respectively. Therefore, even if an irradiation direction of detection light deviates due to installation errors of the photo sensor 34 and the photo sensor 36, detection light can be prevented from deviating from the surface of the continuous paper 12 corresponding to contact areas of the rolling roller 33 and the rolling roller 35.

(4) Since the photo sensor 34 and the photo sensor 36 irradiate detection light to the double printing mark A and the page break mark B of the surface of the continuous paper 12 from the oblique direction, respectively, the accuracy for detecting the double printing mark A and the page break mark B even on the continuous paper 12 with the lustrous surface, respectively, through the photo sensor 34 and the photo sensor 36 can be improved.

(5) The photo sensor 34 and the photo sensor 36 obliquely irradiate detection light to the double printing mark A and the page break mark B on the surface of the continuous paper 12 from the rear side of the front-rear direction, respectively. Therefore, compared to the case in which detection light is irradiated from the photo sensor 34 and the photo sensor 36 to the double printing mark A and the page break mark B on the surface of the continuous paper 12 from an upper side or a lower side of the up-down direction, the double printing mark A and the page break mark B can be detected with higher accuracy.

Modified Embodiment

The embodiment described above may be modified as follows.

The photo sensor 34 and the photo sensor 36 may be disposed to irradiate detection light to the double printing mark A and the page break mark B on the surface of the continuous paper 12 from an arbitrary direction.

The photo sensor 34 and the photo sensor 36 are not necessary to be disposed to irradiate detection light to a location of the surface side of the continuous paper 12, which corresponds to a central location of the transport direction among portions by which an opposite surface side is arcuately supported by an outer peripheral surface of the rolling roller 33 and the rolling roller 35, respectively. That is, the photo sensor 34 and the photo sensor 36 may be disposed to irradiate detection light to a location which deviates to an upper side or a lower side from a central location of the transport direction among portions by which an opposite surface side is arcuately supported at an outer peripheral surface of the rolling roller 33 and the rolling roller 35 in the continuous paper 12, respectively.

The relay roller 28, the relay roller 30, the change-over roller 32, and the inversion roller 47 may be replaced with nip rollers which discharge the continuous paper 12 while pinching the continuous paper 12. That is, the relay roller 28, the relay roller 30, the change-over roller 32, and the inversion roller 47 may have a configuration without a winding function.

Instead of the long-sized continuous paper 12, a single cut sheet may be used.

Instead of the rolling roller 33 and the rolling roller 35, simple round bars which do not rotate and by which the continuous paper 12 slides may be used.

Instead of the continuous paper 12, a long-sized plastic film may be used as a target.

In the embodiment described above, the ink jet type printer 11 is employed as the recording apparatus, but a fluid ejecting apparatus may be used which ejects a liquid other than ink. Further, a liquid ejecting apparatus which has a liquid ejecting head which ejects a small amount of liquid drop may be used. In this case, a liquid drop refers to a state of a liquid ejected from the liquid ejecting apparatus and includes granule, tear, or thread states which form a trail. A liquid refers to a material which can be ejected by a liquid ejecting apparatus. For example, when a material is in a liquid phase state, a liquid-like substance having high or low viscosity, a fluid-like substance such as a sol, gel water, an inorganic solvent, an organic solvent, a solution, liquid-phase resin, and liquid metal (a metallic melt), and a particle of a functional material including a solid substance such as a pigment or a metallic particle which is dissolved, dispersed or mixed in a solvent as well as a liquid as one state of a material may be included. Representative examples of a liquid include ink described in the above-described embodiment and a liquid crystal. Here, ink includes various liquid compositions such as general water-based ink, oil-based ink, gel ink, and hot-melt ink. Examples of a liquid ejecting apparatus include a liquid ejecting apparatus which ejects a liquid in which a material is dispersed or dissolved such as an electrode material or a coloring material, which is used to manufacture a liquid crystal display device, an electroluminescence (EL) display device, a plane emission display, and a color filter, a liquid ejecting apparatus which ejects a bio-organic material used for manufacturing a bio chip, a liquid ejecting apparatus which ejects a liquid which is a sample used as a precise pipette, a printing apparatus, or a micro-dispenser. A liquid ejecting apparatus which ejects lubricating oil to a precision machine such as a watch or a camera at a pin point, a liquid ejecting apparatus which ejects a transparent resin liquid such as ultraviolet cured resin on a substrate to form a minute hemispheric lens (optical lens) used in an optical communication element or the like, or a liquid ejecting apparatus which ejects an acidic or alkali etchant to etch a substrate may be employed. The invention may be applied to one of the liquid ejecting apparatuses.

What is claimed is:

1. A recording apparatus which performs recording processing on a target which is transported from an upstream side to a downstream side, comprising:

a body having a frame partitioning the body into a first compartment and a second compartment, the second compartment being separate from and above the first compartment along a transport path of a target;

a first support unit which is disposed at an intermediate location of the transport path of the target and supports the target, the target having a first side and a second side opposite the first side, the first support unit being disposed within the first compartment;

a second support unit which is disposed at a location of a downstream side of the transport path of the target further than the first support unit and supports the target, the second support unit being disposed within a printing chamber within the second compartment, the second compartment being associated with transporting the target to and from a location where the recording apparatus performs recording on the target;

a tension applying member which is disposed at a location of the transport path between the first support unit and the second support unit within the second compartment and pressures the target from the first side thereof to apply a tension to the target;

a first optical detection unit which is disposed at a location corresponding to the tension applying member to face the second side of the target and irradiates detection light to a surface of the second side of the target, the first optical detection unit including a light emitting unit and a photo sensor each disposed on an exterior facing surface positioned adjacent to the tension applying member with the target disposed between the exterior facing surface and the tension applying member, wherein each of the exterior facing surface, the light emitting unit and the photo sensor of the first optical detection unit is (i) inclined with respect to the surface of the second side of the target in a width direction that intersects a transport direction of the target, (ii) inclined downwardly towards an end edge of the target in the width direction, and (iii) inclined in the same direction, and wherein the first optical detection unit is configured to obliquely irradiate the surface of the second side in the width direction;

a second optical detection unit, wherein the second optical detection unit is positioned to face the end edge of the target in the width direction;

a platen unit disposed within the printing chamber and being configured to support the target when the recording apparatus performs recording on the target, wherein detection of a printing mark on the target is used to position the target on the platen unit for recording, the platen unit including an elongate length in the transport path, the light emitting unit of the first optical detection unit and another light emitting unit of the second optical detection unit configured to emit light towards the target in a direction of the elongate length, but opposite to each other, with the first optical detection unit being disposed directly upstream of a relay roller configured to direct the target to the platen unit and the second optical detection unit being disposed directly downstream of another relay roller, positioned directly downstream of the platen unit, configured to direct the target from the platen unit, and a controller configured to cooperate with the first optical detection unit and the second optical detection unit, the controller being configured to control driving rollers to position the target on the platen unit, wherein the first optical detection unit is upstream of the platen unit within the printing chamber and the second compartment, and the second optical detection unit is downstream of the platen unit within the printing chamber and the second compartment.

2. The recording apparatus according to claim 1, wherein the tension applying member is a rolling roller which is disposed to come into contact with the first side of the target in a pressured state, and the first optical detection unit irradiates the detection light towards the surface of the second side of a portion which supports the first side of the target at an outer peripheral surface of the rolling roller.

3. The recording apparatus according to claim 2, wherein the first optical detection unit irradiates the detection light toward a central location of a transport direction of a portion of the target supported arcuately along an outer peripheral surface of the rolling roller.

4. The recording apparatus according to claim 1, wherein the controller cooperates with the first optical detection unit to control the driving rollers to position an already printed area on the platen unit and wherein the controller cooperates with the second optical detection unit to control the driving rollers to position a non-printed area of the target on the platen unit.

5. The recording apparatus according to claim 4, wherein the photo sensor is configured to detect diffusion light.

6. The recording apparatus of claim 1, wherein one of the first support unit and the second support unit is on the first side of the target and the other is on the second side of the target.

7. A recording apparatus which performs recording processing on a target which is transported from an upstream side to a downstream side, comprising:

a body having a frame partitioning the body into a first compartment and a second compartment, the second compartment being separate from and above the first compartment along a transport path of a target;

a first support unit which is disposed at an intermediate location of the transport path of the target and supports the target, the target having a first side and a second side opposite the first side, the first support unit being disposed within the first compartment;

a second support unit which is disposed at a location of a downstream side of the transport path of the target further than the first support unit and supports the target, wherein one of the first support unit and the second support unit is on the first side of the target and the other is on the second side of the target, the second support unit being disposed within a printing chamber within the second compartment, the second compartment being associated with transporting the target to and from a location where the recording apparatus performs recording on the target;

a tension applying member which is disposed at a location of the transport path between the first support unit and the second support unit within the second compartment and pressures the target from the first side thereof to apply a tension to the target;

a first optical detection unit which is disposed at a location corresponding to the tension applying member to face the second side of the target and irradiates detection light to a surface of the second side of the target, the first optical detection unit including a light emitting unit and a photo sensor each disposed on an exterior facing surface positioned adjacent to the tension applying member with the target disposed between the exterior facing surface and the tension applying member, wherein each of the exterior facing surface, the light emitting unit and the photo sensor of the first optical detection unit is (i) inclined with respect to the surface of the second side of the target in a width direction that intersects a transport direction of the target, (ii) inclined downwardly towards an end edge of the target in the width direction, and (iii) inclined in the same direction;

a second optical detection unit, wherein the second optical detection unit is positioned to face the end edge of the target in the width direction, the second optical detection unit including a second light emitting unit and a second photo sensor each disposed on a second exterior facing surface positioned adjacent to another tension applying member with the target disposed between the second exterior facing surface and the second tension applying member, each of the second exterior facing surface, the second light emitting unit and the second photo sensor of the second optical detection unit is inclined opposite to the first optical detection unit;

a platen unit disposed within the printing chamber and being configured to support the target when the recording apparatus performs recording on the target, wherein detection of a printing mark on the target is used to position the target on the platen unit for recording, the platen unit including an elongate length in the transport path, the light emitting unit of the first optical detection unit and another light emitting unit of the second optical detection unit configured to emit light towards the target in a direction of the elongate length, but opposite to each other, with the first optical detection unit being disposed directly upstream of a relay roller configured to direct the target to the platen unit and the second optical detection unit being disposed directly downstream of another relay roller, positioned directly downstream of the platen unit, configured to direct the target from the platen unit; and a controller configured to cooperate with the first optical detection unit and the second optical detection unit, the controller being configured to control conveying rollers to position the target on the platen unit, wherein the first optical detection unit is upstream of the platen unit within the printing chamber and the second compartment, and the second optical detection unit is downstream of the platen unit within the printing chamber and the second compartment.

8. A recording apparatus which performs recording processing on a target which is transported from an upstream side to a downstream side, comprising:

a body having a frame partitioning the body into a first compartment and a second compartment, the second compartment being separate from and above the first compartment along a transport path of a target a first support unit which is disposed at an intermediate location of the transport path of the target and supports the target, the target having a first side and a second side opposite the first side, the first support unit being disposed within the first compartment;

a second support unit which is disposed at a location of a downstream side of the transport path of the target further than the first support unit and supports the target, the second support unit being disposed within a printing chamber within the second compartment, the second compartment being associated with transporting the target to and from a location where the recording apparatus performs recording on the target;

a tension applying member which is disposed at a location of the transport path between the first support unit and the second support unit within the second compartment and pressures the target from the first side thereof to apply a tension to the target;

a first optical detection unit which is disposed at a location corresponding to the tension applying member to face the second side of the target and irradiates detection light to a surface of the second side of the target, the first optical detection unit including a light emitting unit and a photo sensor each disposed on an exterior facing surface positioned adjacent to the tension applying member with the target disposed between the exterior facing surface and the tension applying member, wherein each of the exterior facing surface, the light emitting unit and the photo sensor of the first optical detection unit is (i) inclined with respect to the surface of the second side of the target in a width direction that intersects a transport direction of the target, (ii) inclined downwardly towards an end edge of the target in the width direction, and (iii) inclined in the same direction, and wherein the optical detection unit is positioned to face an end edge of the target such that a facing surface of the optical detection unit is obliquely oriented toward the width direction of the target and configured to obliquely irradiate the surface of the second side in the width direction, wherein the width direction intersects a transport direction of the target;

a second optical detection unit, wherein the second optical detection unit is positioned to face the end edge of the target in the width direction, the second optical detection unit including a second light emitting unit and a second photo sensor each disposed on a second exterior facing surface positioned adjacent to another tension applying member with the target disposed between the second exterior facing surface and the second tension applying member, each of the second exterior facing surface, the second light emitting unit and the second photo sensor of the second optical detection unit is inclined opposite to the first optical detection unit;

a platen unit disposed within the printing chamber and being configured to support the target when the recording apparatus performs recording on the target, wherein detection of a printing mark on the target is used to position the target on the platen unit for recording, the platen unit including an elongate length in the transport path, the light emitting unit of the first optical detection unit and another light emitting unit of the second optical detection unit configured to emit light towards the target in a direction of the elongate length, but opposite to each other, with the first optical detection unit being disposed directly upstream of a relay roller configured to direct the target to the platen unit and the second optical detection unit being disposed directly downstream of another relay roller, positioned directly downstream of the platen unit, configured to direct the target from the platen unit; and a controller configured to cooperate with the first optical detection unit and the second optical detection unit, the controller being configured to control conveying rollers to position the target on the platen unit, wherein the first optical detection unit is upstream of the platen unit within the printing chamber and the second compartment, and the second optical detection unit is downstream of the platen unit within the printing chamber and the second compartment.

* * * * *